US012577876B2

(12) United States Patent
Larrick et al.

(10) Patent No.: US 12,577,876 B2
(45) Date of Patent: Mar. 17, 2026

(54) COMPACT MACHINE FOR CARRYING TOOLS

(71) Applicant: Pioneer Conveyor, LLC, Mt. Lake Park, MD (US)

(72) Inventors: Robert B. Larrick, Morgantown, WV (US); Timothy D. Beeman, Lonaconing, MD (US); Reuben J. Ruggiero, Accident, MD (US); Courtland J. Helbig, Morgantown, WV (US); James C. Stephens, III, Hagerstown, MD (US)

(73) Assignee: Pioneer Conveyor, LLC, Mt. Lake Park (MD)

( * ) Notice: Subject to any disclaimer, the term of this patent is extended or adjusted under 35 U.S.C. 154(b) by 41 days.

(21) Appl. No.: 18/806,921

(22) Filed: Aug. 16, 2024

(65) Prior Publication Data

US 2025/0067124 A1 Feb. 27, 2025

Related U.S. Application Data

(60) Provisional application No. 63/534,382, filed on Aug. 24, 2023.

(51) Int. Cl.
*E21C 33/00* (2006.01)

(52) U.S. Cl.
CPC ..... *E21C 33/00* (2013.01)

(58) Field of Classification Search
CPC ..... E21C 33/00
See application file for complete search history.

(56) References Cited

U.S. PATENT DOCUMENTS

| | | | | |
|---|---|---|---|---|
| 5,738,415 | A * | 4/1998 | Parrott | E21C 35/187 299/106 |
| 6,109,700 | A | 8/2000 | Branson et al. | |
| 6,267,191 | B1 | 7/2001 | Hettinger | |
| 9,200,423 | B2 | 12/2015 | Helbig et al. | |
| 2007/0158995 | A1 * | 7/2007 | Suilmann | E21F 5/02 299/81.3 |
| 2010/0119311 | A1 | 5/2010 | Voss | |

FOREIGN PATENT DOCUMENTS

| | | | | |
|---|---|---|---|---|
| AU | 2010264099 | B2 * | 5/2016 | E21D 23/12 |
| CN | 103277045 | A | 9/2013 | |
| DE | 102012107484 | A1 * | 2/2014 | E21F 13/06 |
| EP | 1080621 | A1 * | 3/2001 | A01B 51/026 |

OTHER PUBLICATIONS

Hutchinson, T., "Fluid Power Generation & Transportation Systems for Longwalls", Morgantown Machine & Hydraulics Swanson Industries, Jan. 3, 2013, pp. 1-6, Morgantown, West Virginia, USA.

* cited by examiner

*Primary Examiner* — Kyle Armstrong
(74) *Attorney, Agent, or Firm* — COATS & BENNETT, PLLC

(57) ABSTRACT

The present invention is a relatively narrow tool carrying self-propelled machine that is particularly configured such that it can easily move through narrow mines while supporting any one of several tools. In one embodiment, the self-propelled machine is designed to be powered totally or substantially totally by an emulsion fluid that is readily available in mines.

14 Claims, 10 Drawing Sheets

COMPACT MACHINE FOR CARRYING TOOLS

RELATED APPLICATIONS

This application claims priority to U.S. Provisional Application No. 63/534,382, filed Aug. 24, 2023, the disclosure of which is incorporated by reference herein in its entirety.

FIELD OF THE INVENTION

The present invention relates to self-propelled tool carrier machines, and more particularly to compact tool carrying machines designed to be highly maneuverable in confined spaces, such as underground mines.

BACKGROUND AND SUMMARY OF THE INVENTION

Many different types of tools are used in mine operations. Some of the tools such as drills are large, heavy and challenging to manipulate and handle. Seemingly, self-propelled machines could carry these tools and control and manipulate them while they are performing various tasks in mines. But in reality, it has been difficult to develop relatively simple and cost-effective self-propelled tool carrying machines for mines. There are a number of reasons for this. First, the spaces that these self-propelled machines operate in are extremely narrow and confining. That in itself makes it difficult to design an effective, self-propelled tool carrying machine for mine operations. Secondly, certain machines used in mines must meet stringent regulatory requirements, such as MSHA certification, and in such cases, regulatory requirements make it difficult to design a cost-effective and practical self-propelled machine for supporting and manipulating tools in mines.

The present invention addresses these challenges. Accordingly, the present invention is a relatively narrow tool carrying, self-propelled machine that is particularly configured such that it can easily move through narrow mines while supporting any one of a variety of tools. In one embodiment, the self-propelled machine is designed to be powered totally, or substantially totally, by an emulsion fluid that is readily available in mines. One of the features of the machine is that it includes a tool carrier for supporting various tools, such as drills. The tool carrier is operatively connected to the remote end of a boom via a tool head. The tool head and tool carrier are designed such that the tool carrier can be rotated a full 360° about an axis. Moreover, the tool carrier itself includes means to elevate the tool supported therein. Between the boom, tool head and tool carrier, the tool can be lifted and rotated to assume many different positions and orientations.

Other objects and advantages of the present invention will become apparent and obvious from a study of the following description and the accompanying drawings which are merely illustrative of the invention.

DESCRIPTION OF THE INVENTION

Figure 1:
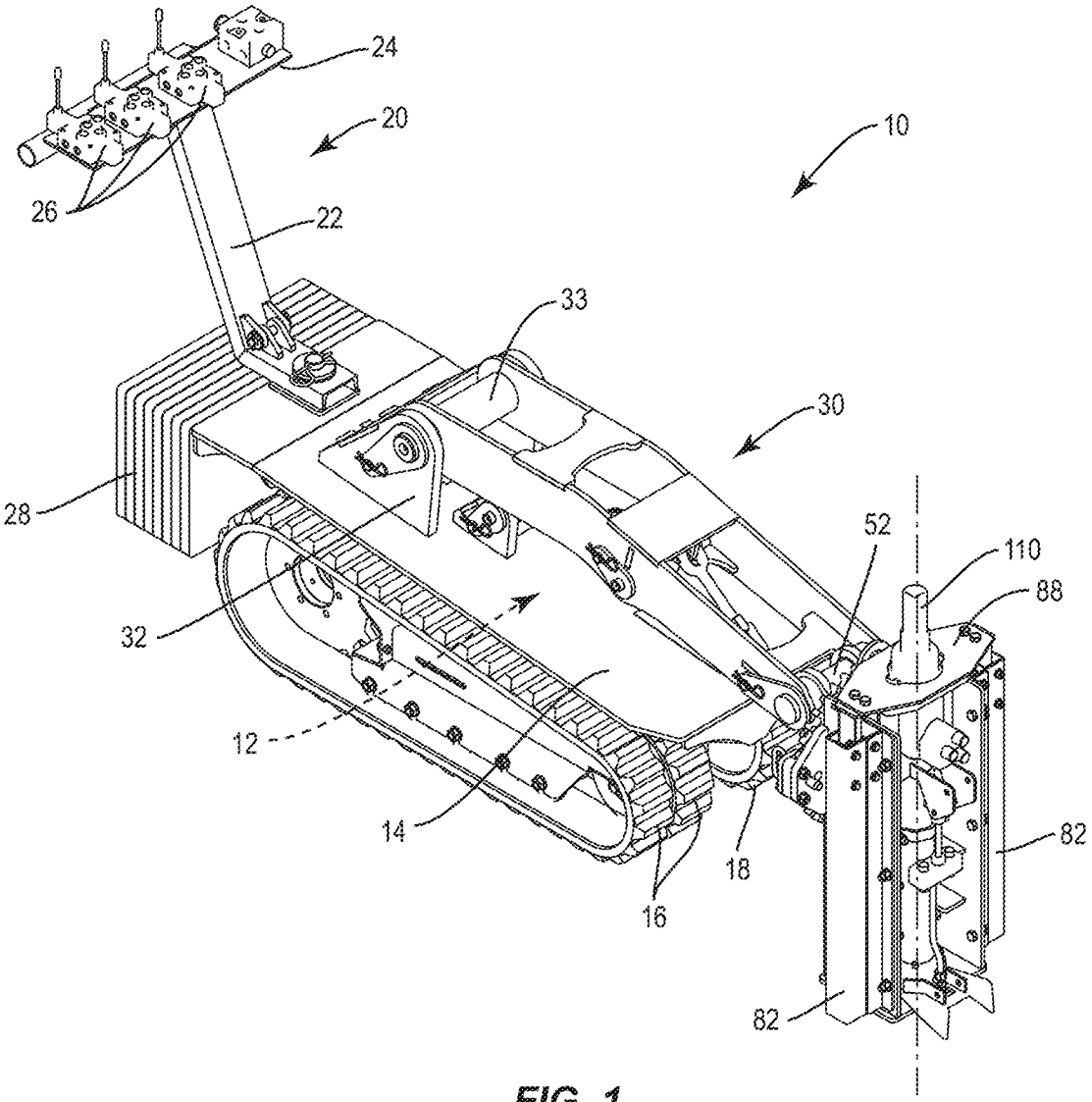
FIG. 1 is a perspective view of the compact tool carrying machine.
Figure 2:
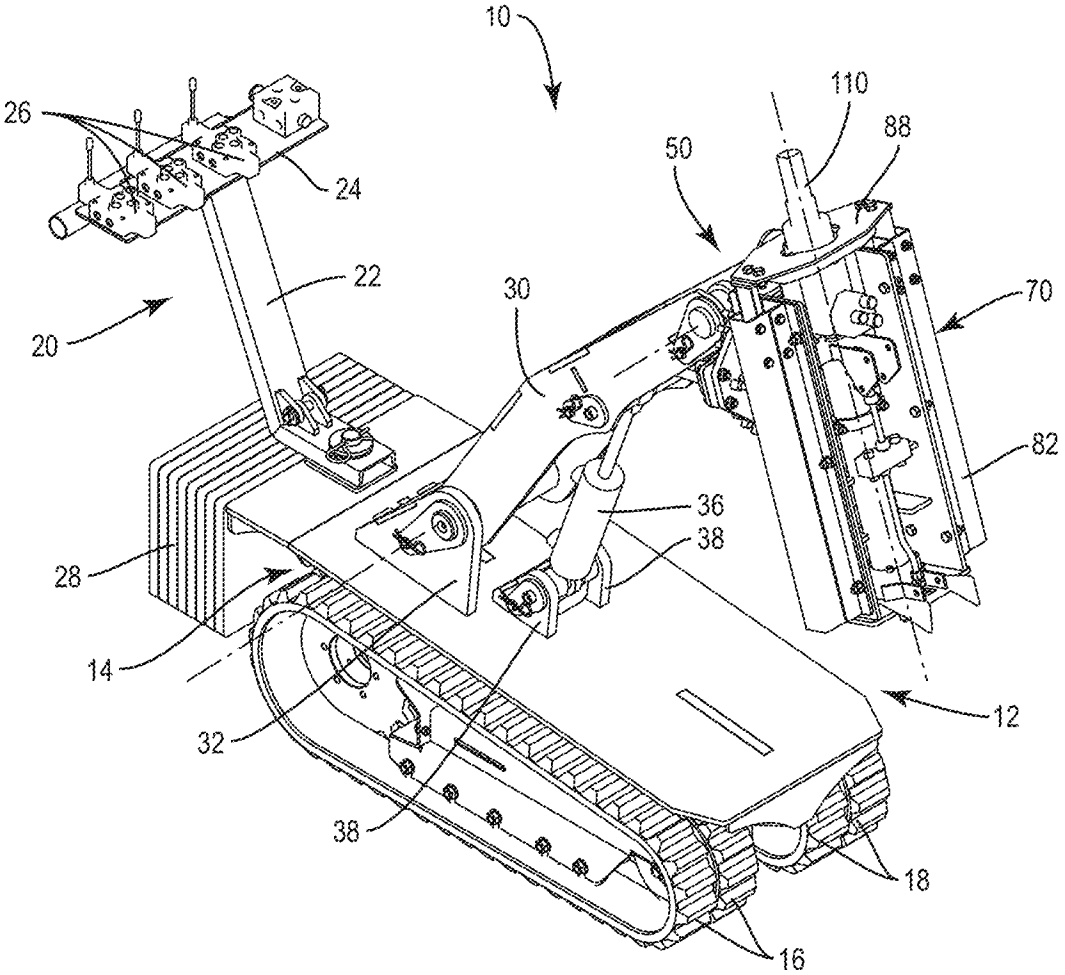
FIG. 2 is a perspective view of the tool carrying machine showing the boom and tool carrier in an elevated position.
Figure 3:
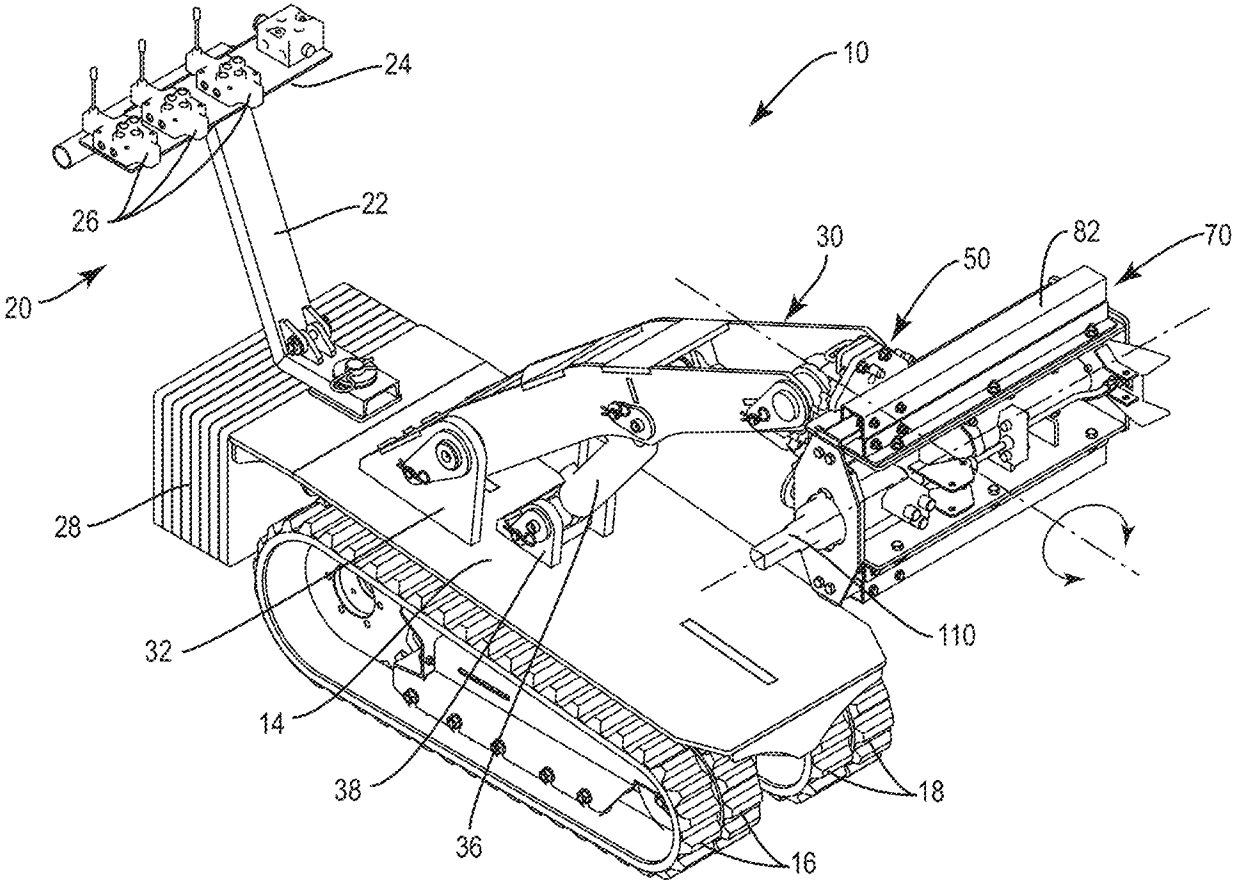
FIG. 3 is a perspective view similar to FIG. 2 but showing the tool carrier rotated to a generally horizontal position.

With further reference to the drawings, FIGS. 1-3, the present invention entails a compact machine 10 specifically designed to support and carry various tools. Machine 10, in one embodiment, is relatively narrow and has an overall width of approximately 24 inches. It is understood, however, that the machine 10 can assume various widths depending on the application that the machine is designed for. As will be appreciated from the further disclosures appearing below, machine 10 can be used in many applications, but it is particularly suited for use in mining operations, such as longwall mining.

Machine 10 includes a chassis or main frame structure indicated generally by the numeral 12. Chassis 12 includes an upper platform 14 that sets atop a series of endless tracks which are in turn driven, at least indirectly, by hydraulic motors. As seen in the drawings, the tracks comprise two pair of tracks with one pair being referred to by the numeral 16 and the other pair being referred to by the numeral 18. Emulsion fluid (which is typically 90-98% water and the rest an oil surfactant), which is readily accessible in mining applications, can be directed under pressure to hydraulic motors which in turn drive a series of drive sprockets that engage the tracks 16 and 18, which results in machine 10 being propelled across a surface. People skilled in the art understand and appreciate that tracks 16 and 18 are simply one embodiment for supporting and propelling the machine 10. Other approaches, such as wheels, can be employed. Various power sources can be utilized to drive the machine 10, its boom and the other driven components of the machine. In one embodiment, there is provided an emulsion fluid power unit that is supported on the machine and configured or designed to drive the machine, power the hydraulic cylinder that raises and lowers the book and powers substantially all power requirements of the machine. The emulsion power unit is configured to connect to an emulsion fluid source that is typically accessible in a mining environment.

Platform 14 extends rearwardly beyond the tracks 16 and 18. A walk-behind operator station or control station 20 is mounted on the rear portion of platform 14. Control station 20 includes an L-shaped member 22 that is pivotally secured to the platform and extends generally rearwardly and upwardly therefrom. Secured to an upper portion of the L-shaped member 22 is a valve support bar 24. Note that the valve support bar 24 extends generally horizontally and has mounted thereon a series of hand-operated control valves 26. Control valves 26 control various hydraulic components of the machine. For example, the control valves 26 control hydraulic drive motors that effectively propel and steer the machine 10, a boom structure that is discussed below and various other fluid powered components that may form a part of the machine 10. Since the L-shaped member 22 is pivotally secured to the platform 14, it follows that the control station 20 can swivel back and forth under the influence of the walk-behind operator.

Secured to the rear portion of the machine 10 is a series of counterweights 28. Counterweights 28 effectively counter the weight of a tool head, tool carrier and tool contained in the carrier that is discussed subsequently herein.

Pivotally mounted to the platform 14 is a boom indicated generally by the numeral 30. Boom 30 is rotatively mounted about a pivot shaft 33 that is supported by a pair of spaced apart shoulders 32 that extend upwardly from the platform 14. A double-acting hydraulic cylinder 36 is operatively positioned between the platform 14 and the boom 30 for raising and lowering the boom. As seen in FIGS. 1-3, hydraulic cylinder 36 is anchored on a pivot pin or shaft that is supported by supports 38 that extend upwardly from the platform. Cylinder 36 includes rod end 36A that extends from the body of the cylinder to a point on the boom 30. By actuating the cylinder 36 and providing pressurized emulsion fluid, the boom 30 can be raised and lowered.

Operatively connected to the remote end of the boom 30 is a tool head indicated generally by the numeral 50. Connected to the tool head 50 is a tool carrier indicated generally by the numeral 70. See details of the tool head 50 and the tool carrier 70 shown in FIGS. 7-11. As will be explained below, the tool head 50 can be pivoted (i.e. tilted) with respect to the boom 30, and the tool carrier 70 can be rotated with respect to the tool head 50. This enables any tool carried by the tool carrier 70 to be positioned in many different positions and orientations because of the movement of the boom 30, the relative movement of the tool head 50 with respect to the boom, and the ability of the tool carrier 70 to be rotated with respect to the tool head.

Tool head 50 is secured to the remote end or head of the boom 30 at two connecting points. First, the upper portion of the tool head 50 is connected to the remote end of the boom 30 via a pivot pin or shaft 52. The lower portion of tool head 50 is connected to the boom 30 via an adjustable tie rod 54. Tie rod 54 extends generally rearwardly from the tool head 50 to where it pivotally connects to the boom 30 at an intermediate point on the boom. By adjusting the tie rod 54, the tilt angle of the tool head 50 can be adjusted. Means other than the tie rod 54 can be employed to adjust the tilt angle of the tool head 50. For example, a double acting hydraulic cylinder can be used in lieu of the tie rod. That is, a double acting hydraulic cylinder can be operatively connected between an intermediate point on the boom 30 and the tool head 50.

Figure 9:
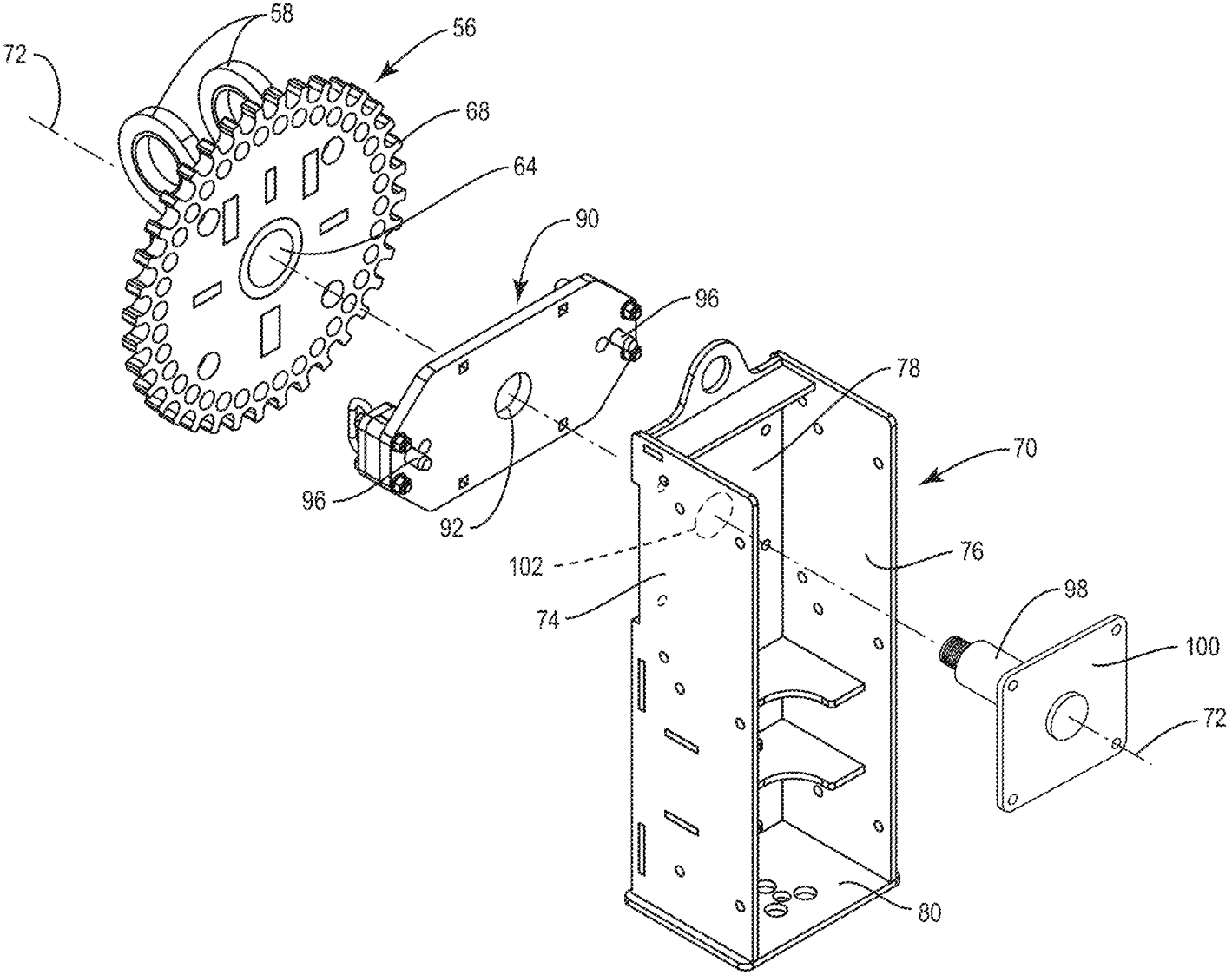
FIG. 9 is an exploded perspective view of portions of the tool carrier and tool head.
Figure 10:
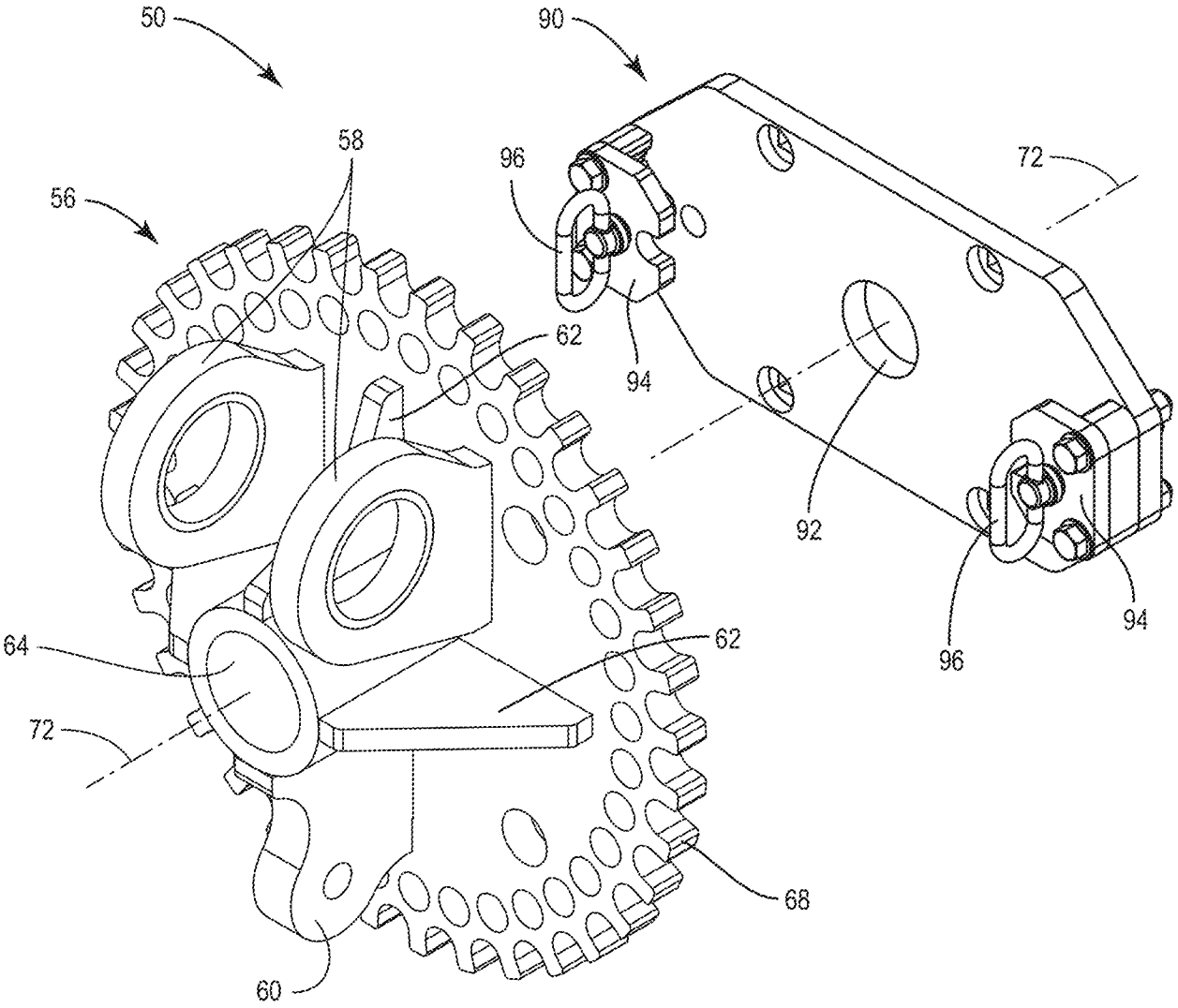
FIG. 10 is a perspective view showing the tool head.
Figure 11:
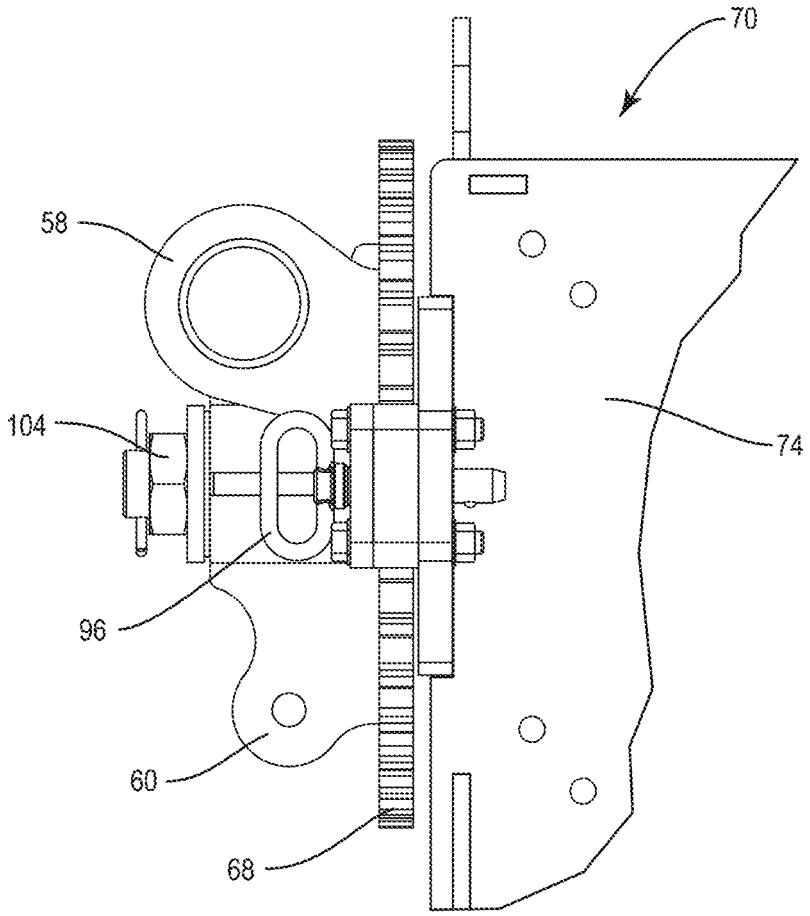
FIG. 11 is a fragmentary side elevational view showing the tool head connected to a portion of the tool carrier.

FIGS. 9 and 10 show details of the tool head 50. Tool head 50 comprises what is referred to as a carrier pivot plate 56. Note that the carrier pivot plate 56 includes a pair of connecting ears 58 that project rearwardly from the carrier pivot plate and are configured to receive the boom head pivot pin or shaft 52. Hence, it is seen that the tool head 50 is directly connected to the remote end of the boom 30 via the pivot shaft 52 and the connecting ears 58 of the carrier pivot plate 56. Also, the carrier pivot plate 56 includes a lower connecting ear 60. See FIG. 10. This connecting ear is connected to the adjustable tie rod 54 that extends between the carrier pivot plate 56 and the boom 30. Note also that the carrier pivot plate 56 includes a number of gussets 62 that extend around a collar or sleeve 64. As will be explained later, the collar or sleeve 64 that forms a part of the carrier pivot plate 56 function to receive a pivot pin that is a journal therein and which enables the tool carrier 70 to rotate about the carrier pivot plate 56. Around the periphery of the carrier pivot plate 56 there is formed a series of spaced apart teeth 68. Defined between consecutive teeth 68 is a series of slots that receive or accept retractable fastening pins (to be described later) that effectively secure the tool carrier 70 to the tool head 50.

As noted above, tool head 50 supports the tool carrier 70. Tool carrier 70 is shown in FIGS. 7, 8, 9 and 11. The tool carrier is designed to receive and support tools. Various types of tools can be supported in the tool carrier 70 and operated while being supported therein. As explained later, one particular use of the tool carrier 70 is to hold and support a drill indicated by the numeral 110 and particularly useful in various longwall mining operations.

In any event, tool carrier 70, as shown in FIG. 9, includes a base frame that includes opposed sides 74 and 76, a back 78 and a bottom 80. The base frame is open in the front and is provided with various internal structures to physically support the particular tool held therein and to accommodate various components of the tool.

Figure 4:
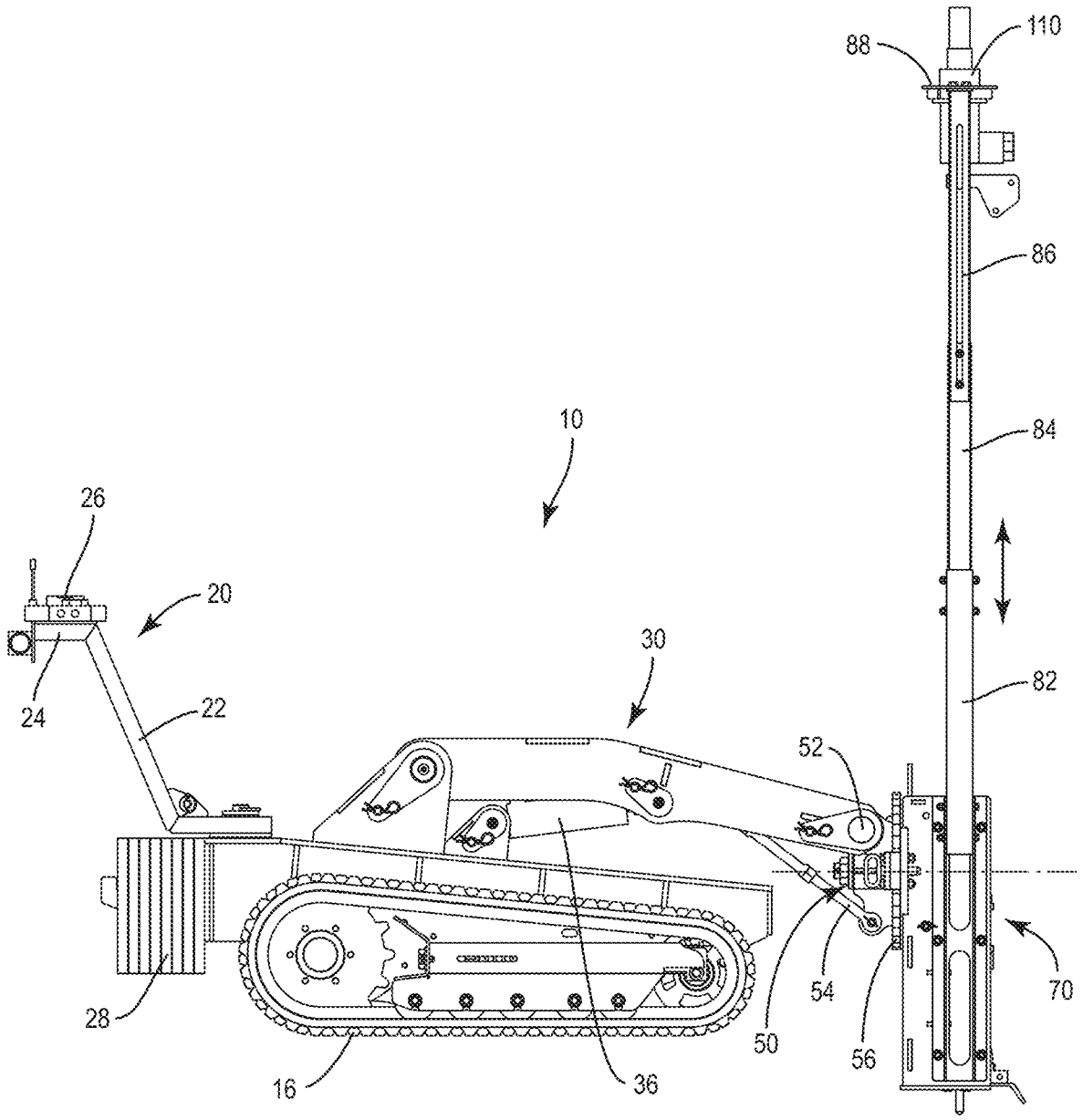
FIG. 4 is a side elevational view of the tool carrying machine showing the tool carrier supporting a drill in an elevated mode.
Figure 5:
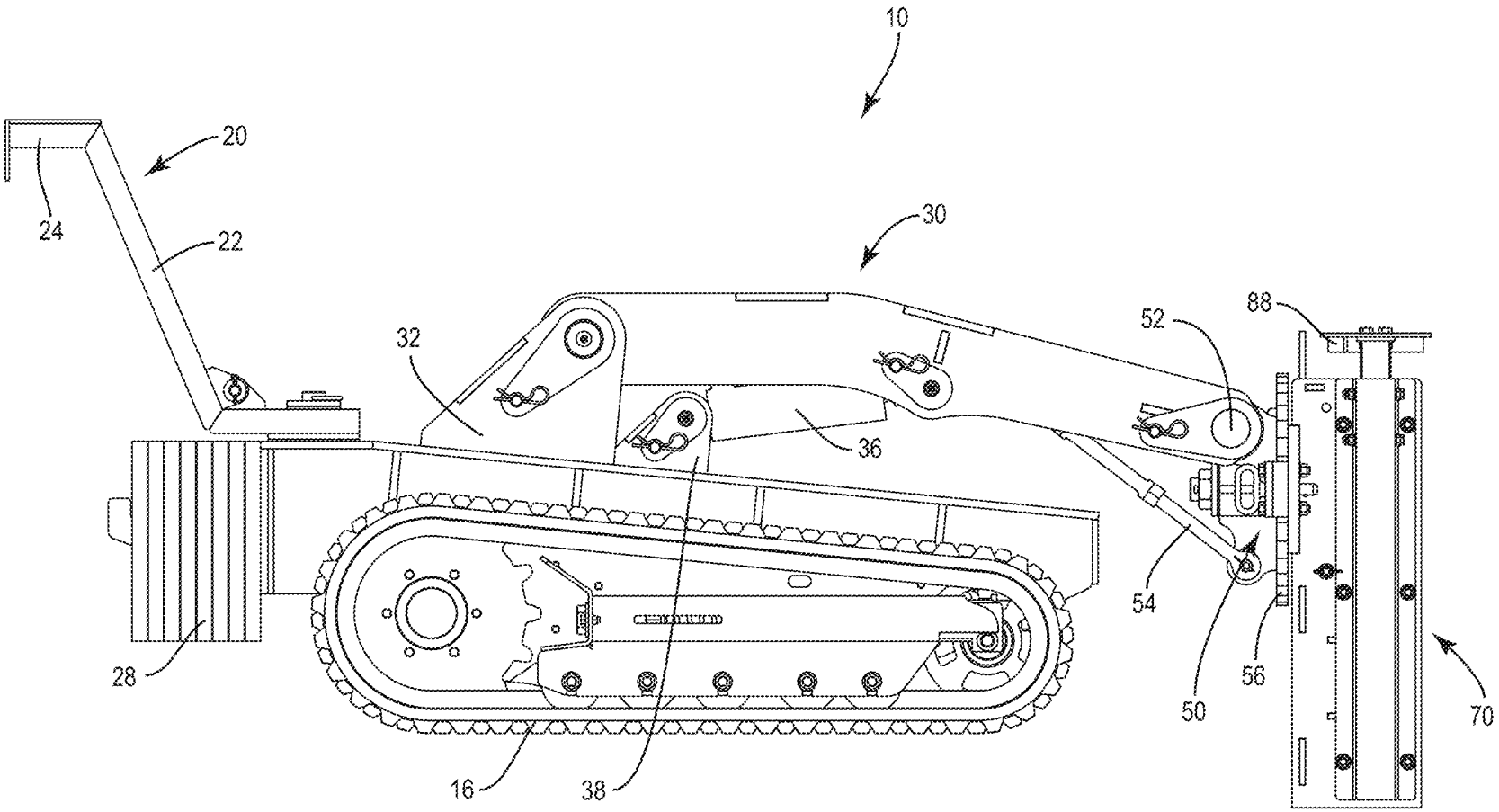
FIG. 5 is another side elevational view of the tool carrying machine of the present invention.
Figure 6:
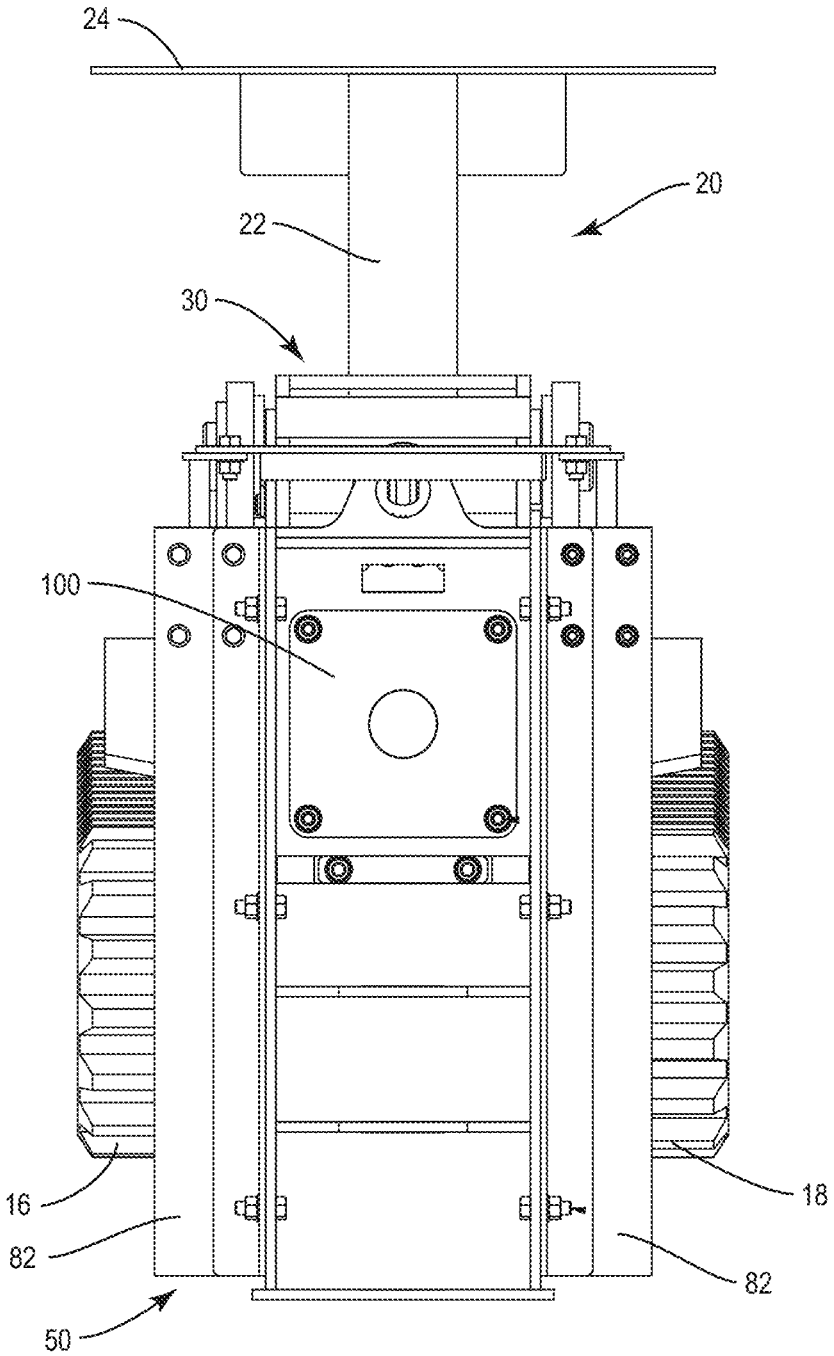
FIG. 6 is a front elevational view of the tool carrying machine.
Figure 7:
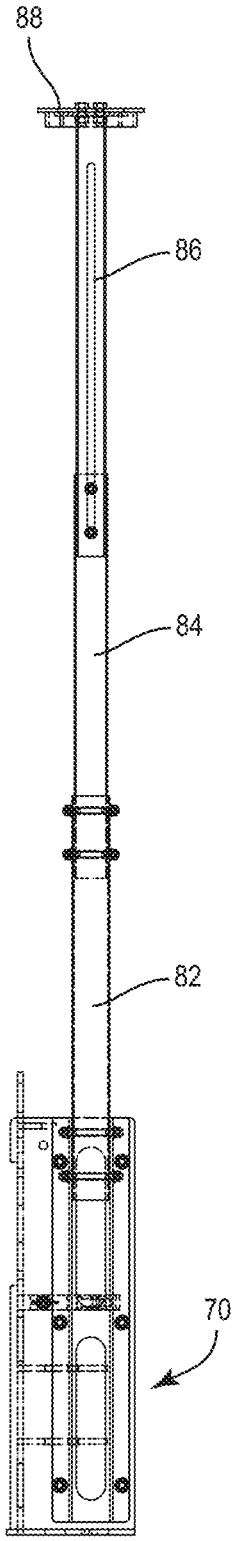
FIG. 7 is a side elevational view of the tool carrier shown in an extended position.
Figure 8:
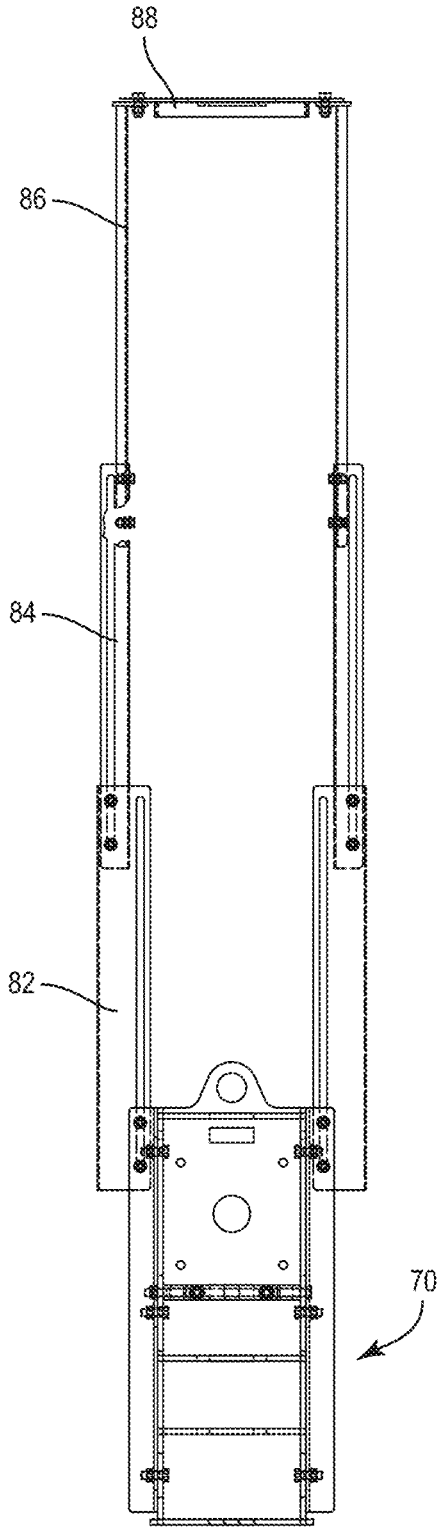
FIG. 8 is a front elevational view of the tool carrier shown in an elevated position.

In some cases, it is advantageous to be able to extend or elevate the tool from the base frame of the tool carrier 70. This is illustrated in FIGS. 4, 7 and 8. Note in the case of FIG. 4 where the tool holder supports the drill 110 and is shown in an extended position where the drill is substantially elevated over the machine 10. To provide this capability for the tool carrier 70, the tool carrier is provided with a pair of telescoping leg assemblies. See FIG. 8. When the pair of telescoping leg assemblies are extended, it is seen that each leg assembly includes a lower leg 82, an intermediate leg 84, and an upper leg 86. Extending across the upper ends of the two upper legs 86 is an anti-rotation cap plate 88. See FIGS. 1, 7 and 8. Anti-rotation cap plate 88 includes an opening through which, in the case of the drill 110 supported in the tool carrier 70, the head of the drill extends through the anti-rotation cap plate which secures the drill therein and prevents the drill from rotating during the operation of the drill. When the pair of leg assemblies are retracted, because of the telescoping nature of the legs, they collapse adjacent the sides 74 and 76 of the base frame of the tool carrier. See FIG. 1.

Tool carrier 70 includes a carrier rotation plate 90 secured to the back 78 of the tool holder 70. A bore 92 is formed in the carrier rotation plate 90. See FIG. 9. On the side of the carrier rotation plate 90 opposite the tool carrier 70, there is provided a pair of structures that wrap around edge portions of the carrier pivot plate 56. Each of these structures includes an outer tabs 94 that is spaced slightly away from the main body of the carrier rotation plate 90. This spacing allows the teeth 68 and the slots therebetween of the carrier pivot plate 56 to pass between the tabs 94 and the main body of the carrier rotation plate 90 when the tool carrier 70 is being rotated with respect to the carrier pivot plate. When the carrier pivot plate 56 and the tool carrier 70 are assembled, the plane of the carrier pivot plate lies in the space between the tabs 94 and the main body of the carrier rotation plate 90. Inserted through the tabs 94 and through the main body of the carrier rotation plate 90 is a pair of retractable locking pins 96. When the carrier pivot plate 56 and tool carrier 70 are connected, these locking pins 96 extend through a pair of slots where each slot lies between a consecutive pair of teeth 68. This effectively prevents the tool carrier 70 from rotating with respect to the carrier pivot plate 56.

Continuing to refer to the tool carrier 70, it includes a carrier pivot pin 98. See FIG. 9. Pivot pin 98 extends from a plate 100 that is secured to the back 78 of the tool carrier 70. Note that back 78 includes an opening 102 through which the pivot pin 98 extends. Bolts extend through the plate 100 and through the back 78 of the tool carrier 70 into the carrier rotation plate 90. This secures the carrier rotation plate 90 to the tool carrier 70. When the tool head 50 and tool carrier 70 are connected, the pivot pin 98 extends through the sleeve or collar 64 in the carrier pivot plate 56. A lock nut 104 or other suitable fastening means is secured to the remote end of the pivot pin 98 (see FIG. 11) so as to secure the tool carrier 70 to the carrier pivot plate 56. That is, the lock nut 104 prevents the tool holder 70 and the carrier pivot plate 56 from separating.

When the tool head 50 and the tool carrier 70 are connected, the carrier rotation plate 90 is secured by bolts to the back 78 of the tool holder and the carrier rotation plate is interposed between the back of the tool holder and the forward facing front of the carrier pivot plate 56. Carrier pivot plate 56 does not directly engage the adjacent carrier rotation plate 90. In normal operations, however, the carrier rotation plate 90 and the attached base frame structure of the tool carrier are fixed with respect to the carrier pivot plate 56 by the pivot pins 96 that extend from the tabs 94 through slots between teeth 68 and into and through the main body of the carrier rotation plate. In this position, the tool carrier 70 cannot rotate with respect to the carrier pivot plate 56.

There are, however, times when it is desirable to rotate and reposition the tool carrier 70. This is accomplished by retracting the pivot pin 96 from the slots between respective teeth 68 in the carrier pivot plate 56. Once this is done, the carrier rotation plate 90, as well as the entire structure of the tool carrier 70 can be rotated around the carrier pivot plate 56. When this rotation adjustment occurs, it follows that the teeth 68 pass through the space that is defined between the tabs 94 and the main body of the carrier rotation plate 90. Once the tool carrier 70 is properly positioned in the desired orientation, the retractable pivot pins 96 are re-inserted through two of the slots formed in the periphery of the carrier pivot plate 56 through the carrier rotation plate 90. Various means can be utilized to lock the pivot pins 96 in place.

As noted above, various types of tools can be held and supported in the tool carrier 70. One particular use of the tool carrier is to support a drill of the type that is commonly used in longwall coal mining. In longwall mining, drills are an important piece of equipment used for various operations relating to the extraction of coal or other minerals from underground seams. Longwall mining has become a highly productive method used to extract quantities of coal in an efficient manner. This involves the use of specialized machinery to create a longwall of coal which is then extracted in slices or panels as the mining progresses.

Drills in longwall mining can serve several purposes, and their usage often depends on the specific stage of the mining process. For example, drills are used to create access to a coal seam. This involves drilling horizontal holes into the seam to create entryways and passageways for the mining equipment. These holes are typically used for installing roof supports, conveyor systems, ventilation and other infrastructure required for longwall operations. Once the access openings are established, drills can be used to create holes in the roof of the coal seam. These holes can be used to install roof support systems which prevent roof collapses and insures the safety of workers and the integrity of the mine. Also, drills can play a role in cutting coal from the seam. Drills are also used in longwall mining for ground control purposes. When coal is extracted, it can create voids and instability in the surrounding rock. To prevent potential roof failure and other hazards, additional drilling may be done to install roof bolts, cable anchors or other support systems.

Thus, because of the many uses of drills in longwall mining, it is advantageous if the machine 10 has the capacity of positioning and orienting a drill in a wide range of positions and orientations. Machine 10 has this capability as illustrated in FIGS. 1-4. In particular, this capability arises because the tool, which in this example is a drill, supported in the tool carrier, can be raised up and down by boom 30, tilted back and forth with respect to the boom 30 by the adjustable tie rod 54, rotated a full 360° about the axis of the tool head 50, and raised and lowered in the tool carrier 70 by the telescoping legs. The positioning and orientation of a tool in the tool carrier 70 is nearly limitless within the confines of longwall mining.

Details of the hydraulic system for powering the machine 10 and boom 30, as well as the power system for the drill 110 (or other tool supported in the tool carrier 70), are not shown and described in detail herein. These systems are well known and appreciated by those skilled in the art and are not per se material to the present invention.

The present invention may, of course, be carried out in other specific ways than those herein set forth without departing from the scope and the essential characteristics of the invention. The present embodiments disclosed herein are therefore to be construed in all respects as illustrative and not restrictive and all changes coming within the meaning and equivalency range of the appended claims are intended to be embraced therein.

What is claimed is:

1. A compact tool carrying machine comprising:
- a chassis supported by tracks or wheels;
- an operator station disposed on the machine;
- a boom pivotally mounted to the machine;
- a hydraulic cylinder operatively connected to the boom for raising and lowering the boom;
- a tool head mounted to a remote end of the boom;
- a tool carrier secured to the tool head; and
- an emulsion fluid power unit supported on said machine and configured to drive said machine, power the hydraulic cylinder that raises and lowers the boom, and powers substantially all power requirements for said machine, and wherein the emulsion fluid power unit is configured to connect to an emulsion fluid source for powering said machine.

2. The machine of claim 1 wherein the tool carrier is configured to receive and support a drill.

3. The machine of claim 1 wherein the tool carrier and tool head are configured such that the tool carrier is rotatable with respect to the tool head.

4. The machine of claim 1 wherein the tool carrier is configured to rotate about an axis at approximately 360° relative to the remote end of the boom.

5. The machine of claim 1 wherein the tool carrier is extendible whereby a tool supported in the tool carrier can be raised and lowered while being supported in the tool carrier.

6. The machine of claim 1:
- wherein the tool head includes a carrier pivot plate having spaced apart teeth and slots therebetween formed around the periphery of the carrier pivot plate;

the carrier pivot plate pivotally mounted about a transverse axis to an end portion of the boom and tiltable up and down with respect to the boom via the transverse axis;

the tool carrier including a base frame configured to receive and hold a tool and a carrier rotation plate secured to the base frame;

a carrier pivot pin secured to the base frame and extending therefrom past the carrier rotation plate and wherein the carrier pivot pin is rotatively journaled in an opening formed in the carrier pivot plate such that the base frame and carrier rotation plate can rotate with respect to the tool head about an axis of the carrier pivot pin; and the carrier rotation plate including at least two retractable locking pins that are moveable between a locked position where the locking pins extend into the slots between adjacent teeth on the carrier pivot plate which fixes the tool carrier with respect to the tool head, and an unlocked position where the locking pins are retracted from the slots which allow the carrier rotation plate to rotate with respect to the carrier pivot plate, which in turn permits the tool carrier to rotate about an axis of the carrier pivot pin.

7. The machine of claim 6 wherein the carrier rotation plate is sandwiched between the base frame of the tool carrier and the carrier pivot plate.

8. The machine of claim 6 wherein the tool carrier includes a pair of spaced apart telescoping leg assemblies that are extendable from a retracted position to an extended position, and wherein there is provided a drill support connected between the upper ends of the pair of leg assemblies and which is configured to receive and support a drill.

9. The machine of claim 8 wherein the drill support includes an anti-rotation cap plate which includes an opening that is configured to receive the drill and which prevents the drill from rotating during the operation of the drill.

10. The machine of claim 6 wherein there is provided an adjustable link operatively connected between the boom and the carrier pivot plate.

11. A relatively narrow mining machine for carrying tools in a mine, the machine comprising:

a chassis supported by tracks or wheels;

an operator station disposed on the rear of the machine;

a boom pivotally mounted on the machine;

a hydraulic cylinder operative connected to the boom for raising and lowering the boom;

a tool head mounted on a remote end of the boom;

a tool carrier configured to carry a mining tool and rotatively mounted to the tool head;

the tool head including a carrier pivot plate configured to support the tool carrier and pivotally mounted about a transverse axis to a remote end of the boom and tiltable up and down about the transverse axis;

an adjustable link operatively connected between the boom and the carrier pivot plate and configured to adjust and station the carrier pivot plate at various angles with respect to said transverse axis;

the tool carrier including a tool support structure for supporting and carrying the mining tool, a carrier rotation plate secured to the tool support structure and sandwiched between the tool support structure and the carrier pivot plate;

the tool carrier further including a shaft that is fixed to said tool support structure and extends past the carrier rotation plate and is rotatively journaled in the carrier pivot plate;

the carrier rotation plate engaged with the carrier pivot plate and rotated about the axis of said shaft and about the carrier pivot plate for varying an angular orientation of the tool support structure; and retractable fasteners carried by said carrier rotation plate for engaging and disengaging with the carrier pivot plate, wherein when the retractable fasteners are engaged with the carrier pivot plate, the tool support structure is fixed relative to the carrier pivot plate, and wherein when said retractable fasteners are disengaged, the tool support structure and the carrier rotation plate is rotatable about the axis of said shaft.

12. The machine of claim 11 wherein the tool support structure includes a pair of spaced apart telescoping assemblies wherein there is provided a tool bar extending between the pair of telescoping assemblies for receiving and supporting the mining tool.

13. The machine of claim 11 wherein the operator station includes a walk-behind operation station that includes a single member pivotally connected to the machine and extending generally upwardly therefrom; and a control bar secured to an upper end portion of the single member for supporting controls that control the machine and the boom.

14. The mining machine of claim 11 wherein the width of the mining machine is approximately 24 inches, which enables the mining machine to maneuver within a mine.

* * * * *